US005894823A

United States Patent [19]

Lee

[11] Patent Number: 5,894,823

[45] Date of Patent: Apr. 20, 1999

[54] VARIABLE SUCTION RESONATOR SYSTEM FOR INTERNAL COMBUSTION ENGINES

[75] Inventor: Sang Hweu Lee, Jeonlabuk-do, Rep. of Korea

[73] Assignee: Hyundai Motor Company, Seoul, Rep. of Korea

[21] Appl. No.: 08/989,546

[22] Filed: Dec. 12, 1997

[30] Foreign Application Priority Data

Dec. 13, 1996 [KR] Rep. of Korea ..... 1996 65601

[51] Int. Cl.[6] ..... F02B 27/02

[52] U.S. Cl. ..... 123/184.57

[58] Field of Search ..... 123/184.57, 184.53

[56] References Cited

U.S. PATENT DOCUMENTS 4,546,733 10/1985 Fukami et al. ..... 123/184.57
4,549,947 10/1985 Sawada et al. ..... 123/184.57
5,002,021 3/1991 Nakata et al. ..... 123/184.57
5,107,800 4/1992 Araki et al. ..... 123/184.57

*Primary Examiner*—Marguerite McMahon
*Attorney, Agent, or Firm*—Christie, Parker & Hale, LLP

[57] ABSTRACT

A variable suction resonator system for internal combustion engines is disclosed. The resonator system generates a variable tuning frequency suitable for freely and effectively meeting and offsetting suction frequencies variable in accordance with the rpm of an engine, thus effectively reducing suction noises of the engine. In the system, an expansible diaphragm interiorly covers a neck, which connects a suction duct to a resonator. A pressure controller selectively pressurizes and expands the diaphragm, thus allowing the diaphragm to control the sectional area of the neck. An electronic control unit calculates an effective tuning frequency of the resonator in response to the rpm of an engine, thus controlling the pressure controller and allowing the sectional area of the neck to be selectively changed by the diaphragm.

3 Claims, 2 Drawing Sheets

【FIG.1】
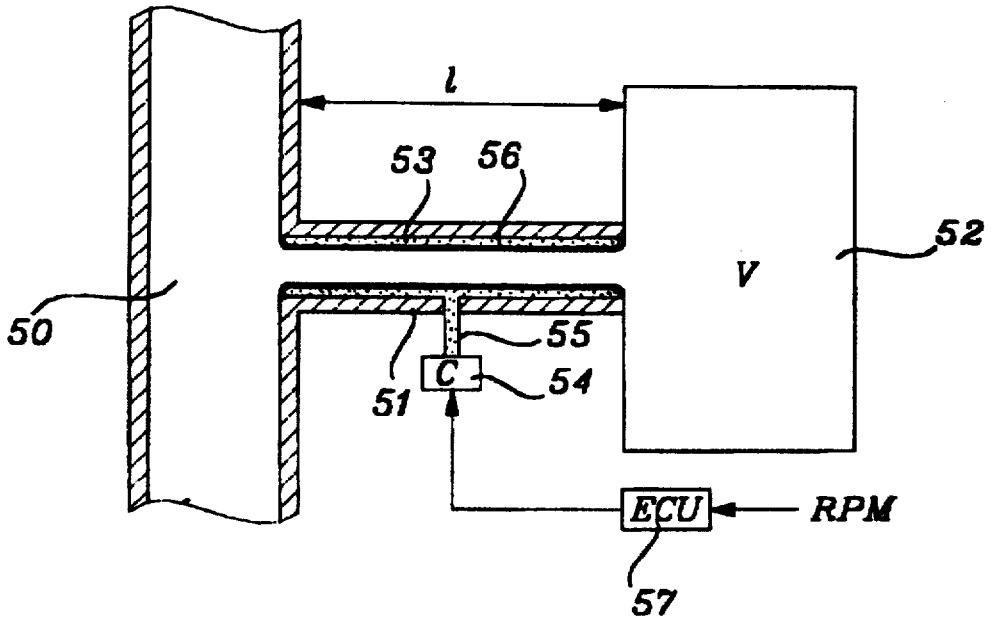
【FIG.2a】
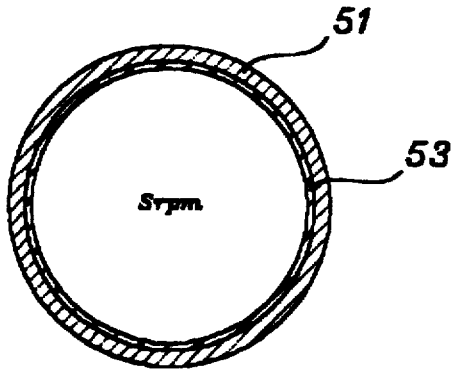

【FIG.2b】
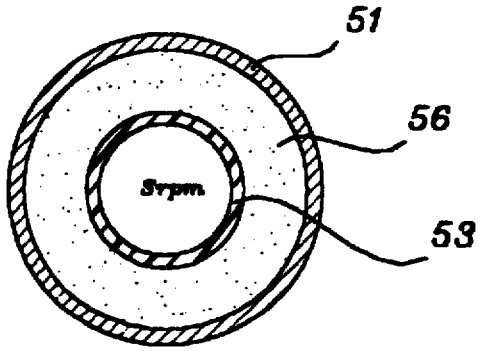
【FIG.3(Prior Art)】
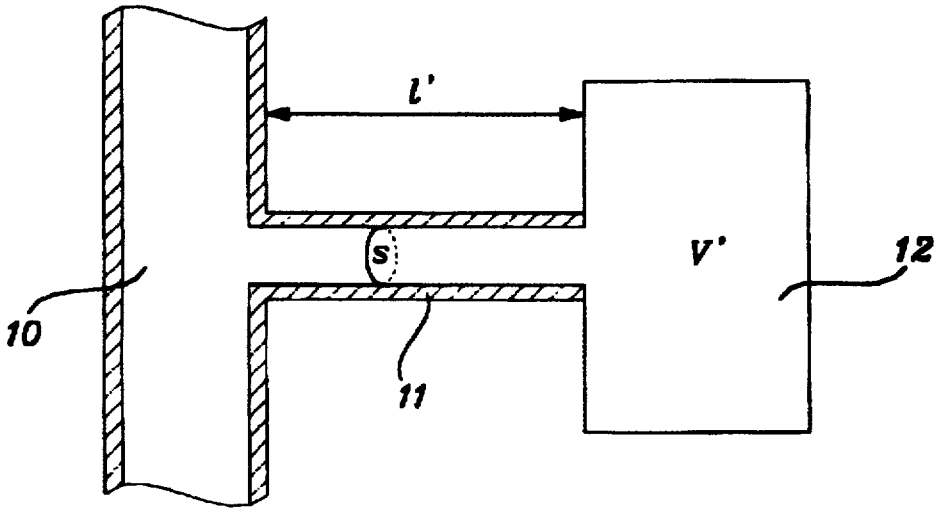

VARIABLE SUCTION RESONATOR SYSTEM FOR INTERNAL COMBUSTION ENGINES

BACKGROUND OF THE INVENTION

1. Field of the Invention

The present invention relates, in general, to a suction resonator system installed in an air suction part of an internal combustion engine and used for reducing suction noises of the suction system by offsetting the suction frequency of the suction system using a tuning frequency and, more particularly, to a variable suction resonator system capable of generating a variable tuning frequency suitable for effectively reducing the suction noises regardless of suction frequencies variable in accordance with the rpm of an engine.

2. Description of the Prior Art

FIG. 3 shows the construction of a typical suction resonator system for internal combustion engines. As shown in the drawing, the typical suction resonator system comprises a suction duct 10 through which atmospheric air is sucked into a cylinder (not shown) of an engine. A resonator 12 is connected to the suction duct 10 through a neck 11 and generates a resonance frequency.

In the operation of the above resonator system, the resonator 12 forms a wave motion, which has a tuning frequency corresponding to the frequency of air flowing through the duct 10, thus reducing suction noises generated from the sucked air in the duct 10.

As well known to those skilled in the art, such suction noises are variable in accordance with the rpm of an engine. Therefore, when such a resonator 12 is designed, it is necessary to perform an analysis of variable suction frequencies within a range of expected rpm of an engine prior to determining a suction frequency, which generates the loudest suction noise, thus being most effectively offset by the tuning frequency of the resonator 12.

In such a resonator 12, the tuning frequency (f) is determined by the volume (V') of the resonator 12 and the sectional area (S) and length (l') of the neck 11 as will be represented by the following expression.

$$f=[C/2\pi]\cdot\{\sqrt{S/[(l'+\delta)\cdot V']}\}$$

wherein C is a constant, and δ is a compensation parameter for the variable configuration of the neck 11.

However, such a suction resonator system is problematic in that it is designed to generate a fixed tuning frequency, which does not effectively meet and offset the suction frequencies variable in accordance with the rpm of an engine, thus failing to effectively reduce suction noises of the engine.

SUMMARY OF THE INVENTION

Accordingly, the present invention has been made keeping in mind the above problems occurring in the prior art, and an object of the present invention is to provide a variable suction resonator system, which generates a variable tuning frequency suitable for freely and effectively meeting and offsetting suction frequencies variable in accordance with the rpm of an engine, thus effectively reducing suction noises of the engine.

In order to accomplish the above object, the present invention provides a variable suction resonator system for internal combustion engines, comprising a suction duct, and a resonator connected to the suction duct through a neck and adapted for generating a tuning frequency capable of offsetting a suction frequency of the suction duct, thus reducing suction noises of the suction duct, further comprising: an expansible diaphragm interiorly covering the neck, thus defining an expansible space between the diaphragm and the neck; a pressure controller connected to the expansible space and adapted for selectively pressurizing and expanding the expansible space, thus allowing the diaphragm to control the sectional area of the neck; and an electronic control unit connected to the pressure controller and adapted for calculating an effective tuning frequency of the resonator in response to the rpm of an engine and outputting a control signal to the pressure controller, thus allowing the sectional area of the neck to be selectively changed by the diaphragm and allowing the resonator to generate the effective tuning frequency.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a sectional view showing the construction of a variable resonator system in accordance with the preferred embodiment of the present invention;

FIGS. 2*a* and 2*b* are cross-sectional views of a neck, which is used for connecting the resonator to the suction duct in the resonator system of this invention and interiorly provided with an expansible diaphragm, in which:

FIG. 2*a* shows the neck, with the diaphragm being free from any pressurized material and maintaining the original sectional area of the neck; and FIG. 2*b* shows the neck, with the diaphragm being expanded by a pressurized material and controllably reducing the sectional area of the neck; and FIG. 3 is a sectional view showing the construction of a typical suction resonator system for internal combustion engines.

DESCRIPTION OF THE PREFERRED EMBODIMENTS

FIG. 1 is a sectional view showing the construction of a variable resonator system in accordance with the preferred embodiment of the present invention. As shown in the drawing, the resonator system of this invention comprises a suction duct 50 through which atmospheric air is sucked into a cylinder (not shown) of an engine. A resonator 52 is connected to the suction duct 50 through a neck 51 and generates a resonance frequency. The resonator system also includes an expansible diaphragm 53, which totally and interiorly covers the neck 51 with both ends of the diaphragm 53 being respectively attached to both ends of the neck 51. The diaphragm 53 thus defines an expansible space between the diaphragm 53 and the neck 51 and controls the sectional area $S_{rpm}$ of the neck 51. A pressure controller 54 is connected to the side wall of the neck 51 through a pressure pipe 55, thus selectively pressurizing and expanding the diaphragm 53. The pressure controller 54 is also connected to an ECU (electronic control unit) 57. The ECU 57 is for calculating an effective tuning frequency $f_{rpm}$ of the resonator 52 in response to the rpm of an engine prior to outputting a control signal to the pressure controller 54. In response to such a control signal, the pressure controller 54 feeds an appropriate amount of pressurized material into the expansible space of the diaphragm 53, thus pressurizing and expanding the diaphragm 53 and controllably reducing the sectional area $S_{rpm}$ of the neck 51. In the present invention, pressurized air or oil may be effectively used as the above pressurized material.

In the operation of the above variable resonator system, an rpm signal, which is indicative of the rpm of an engine, is applied from an rpm sensor (not shown) to the ECU 57. In response to such an rpm signal, the ECU 57 calculates an effective tuning frequency of the resonator 52, which effectively offsets a suction frequency corresponding to the rpm. Thereafter, the ECU 57 outputs a control signal to the pressure controller 54. Upon receiving the control signal from the ECU 57, the pressure controller 54 feeds an appropriate amount of pressurized material into the expansible space, defined between the neck 51 and the diaphragm 53, through the pressurized pipe 55.

During a normal state as shown in FIG. 2*a*, the diaphragm 53 is free from any pressurized material, thus being brought into contact with the inner surface of the neck 51 without leaving any space between the neck 51 and the diaphragm 53. However, when the pressurized material is fed into the expansible space between the neck 51 and the diaphragm 53 by the pressure controller 54 as described above, the diaphragm 53 is pressurized and expanded as shown in FIG. 2*b*, thus controllably reducing the sectional area $S_{rpm}$ of the neck 51.

In the operation of the ECU 57, the effective tuning frequency $f_{rpm}$ of the resonator 52, which effectively offsets a suction frequency corresponding to the rpm of an engine, is determined by the volume (V) of the resonator 52 and the sectional area ($S_{rpm}$) and length (l) of the neck 51, with the sectional area ($S_{rpm}$) of the neck 51 being variable in accordance with the rpm of the engine. That is, the effective tuning frequency $f_{rpm}$ of the resonator 52 will be represented by the following expression.

$$f_{rpm}=[C/2\pi]\cdot\{\sqrt{S_{rpm}/[(l+\delta)\cdot V]}\}$$

wherein C is a constant, and δ is a compensation parameter for the variable configuration of the neck 51.

As described above, the present invention provides a variable suction resonator system. The resonator system generates a variable tuning frequency suitable for freely and effectively meeting and offsetting suction frequencies variable in accordance with the rpm of an engine, thus effectively reducing suction noises of the engine.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A variable suction resonator system for internal combustion engines, comprising a suction duct, and a resonator connected to said suction duct through a neck and adapted for generating a tuning frequency capable of offsetting a suction frequency of the suction duct, thus reducing suction noises of the suction duct, further comprising:

an expansible diaphragm interiorly covering said neck, thus defining an expansible space between the diaphragm and the neck;

a pressure controller selectively pressurizing and expanding the expansible space, thus allowing the diaphragm to control the sectional area of the neck; and an electronic control unit calculating an effective tuning frequency of said resonator in response to the rpm of an engine and outputting a control signal to said pressure controller, thus allowing the sectional area of the neck to be selectively changed by the diaphragm and allowing said resonator to generate the effective tuning frequency.

2. The variable suction resonator according to claim 1, wherein said pressure controller selectively feeds pressurized oil into said expansible space, thus pressurizing and expanding the expansible space.

3. The variable suction resonator according to claim 1, wherein said pressure controller selectively feeds pressurized air into said expansible space, thus pressurizing and expanding the expansible space.

* * * * *